US007982710B2

(12) United States Patent
Machida et al.

(10) Patent No.: US 7,982,710 B2
(45) Date of Patent: Jul. 19, 2011

(54) DRIVING DEVICE FOR IMAGE DISPLAY MEDIUM

(75) Inventors: Yoshinori Machida, Kanagawa (JP); Yasufumi Suwabe, Kanagawa (JP); Yoshiro Yamaguchi, Kanagawa (JP); Takeshi Matsunaga, Kanagawa (JP); Atsushi Hirano, Kanagawa (JP); Kiyoshi Shigehiro, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 920 days.

(21) Appl. No.: 11/599,357

(22) Filed: Nov. 15, 2006

(65) Prior Publication Data

US 2007/0236448 A1 Oct. 11, 2007

(30) Foreign Application Priority Data

Apr. 5, 2006 (JP) ..... 2006-104491

(51) Int. Cl.
*G09G 3/34* (2006.01)

(52) U.S. Cl. ..... 345/107; 359/296

(58) Field of Classification Search ..... 345/107; 359/296

See application file for complete search history.

(56) References Cited

U.S. PATENT DOCUMENTS

| | | | | |
|---|---|---|---|---|
| 2007/0057905 | A1 * | 3/2007 | Johnson et al. | 345/107 |
| 2007/0146306 | A1 * | 6/2007 | Johnson et al. | 345/107 |
| 2007/0205978 | A1 * | 9/2007 | Zhou et al. | 345/107 |
| 2008/0158142 | A1 * | 7/2008 | Zhou et al. | 345/107 |

FOREIGN PATENT DOCUMENTS

| | | | |
|---|---|---|---|
| JP | A 2001-312225 | | 11/2001 |
| JP | A 2004-86095 | | 3/2004 |
| WO | WO2005/008623 | A1 * | 1/2005 |
| WO | WO2005/088600 | A2 * | 9/2005 |
| WO | WO2005/088603 | A2 * | 9/2005 |
| WO | WO2005/101362 | A1 * | 10/2005 |

* cited by examiner

*Primary Examiner* — Sumati Lefkowitz
*Assistant Examiner* — Robert E Carter, III
(74) *Attorney, Agent, or Firm* — Oliff & Berridge, PLC

(57) ABSTRACT

There is provided a driving device for an image display medium that drives the image display medium including: a display substrate; a back surface substrate; plural first electrodes; plural second electrodes; and particles enclosed between the display substrate and the back surface substrate so as to move according to an electric field generated between the substrates by applying a voltage corresponding to an image between the first and second electrodes; the driving device including: a voltage application section that applies the voltage corresponding to an image between the first and second electrodes, the voltage application section, as a display drive voltage to be applied for each pixel to display a desired color at each pixel, applying a first pulse voltage that can cause the particles in a stationary state to start moving and thereafter applying a second pulse voltage that can cause the particles that have started moving to move.

20 Claims, 10 Drawing Sheets

DRIVING DEVICE FOR IMAGE DISPLAY MEDIUM

BACKGROUND

1. Technical Field

The present invention relates to a driving device for an image display medium, more specifically, to a driving device for a repeatedly rewritable image display medium that displays an image by applying voltage between the substrates to move the colored particles.

2. Related Art

Conventionally, an image display medium that uses colored particles is known as a repeatedly rewritable image display medium having memory capability. Such image display medium is configured including for example, a pair of substrates, and plural types of particle groups of different color and charge property that are enclosed between the substrates so as to be movable between the substrates by the applied electric field. A gap member for partitioning the space between the substrates into plural cells is arranged between the substrates to prevent the particles from concentrating at one region of the substrate and the like.

In such image display medium, the voltage corresponding to the image is applied between the pair of substrates to move the particles, and the image is displayed as a contrast of the particles of different color. The particles remain adhered to the substrate by van der Waals' force or image force even after the application of the voltage is stopped, thereby maintaining the image display.

The response (mobility) of the particles with respect to the applied voltage depends on the time (pulse width) in which the voltage is applied or the voltage value. The response with respect to the applied voltage significantly differs between the particles that are adhered to the substrate and the particles that are stripped from the substrate and that have started moving.

In other words, the conditions of the application voltage necessary to move the particles in a stationary state (state the particles adhered to the substrate and in a stationary state) differ from the conditions of the application voltage necessary to move the particles starting of moving. The voltage application time (pulse width) of a certain extent is necessary to move the particles in the stationary state. For example, with regards to the particles having a particle diameter of $\phi 15$ μm, the pulse width of about a few msec is required to sufficiently start the movement of the particles in the stationary state, and the particles may not be moved at the pulse width of less than or equal to 1 msec (frequency of greater than or equal to 500 Hz). Applying plural pulse voltages is effective in increasing the display density, but the display switching time increases significantly if the number of pulse of a few msec increases.

SUMMARY

According to an aspect of the invention, there is provided a driving device for an image display medium that drives the image display medium including: a display substrate having at least translucency; a back surface substrate facing the display substrate with a gap therebetween; plural first electrodes arranged in parallel along a predetermined direction; plural second electrodes arranged facing the first electrodes; and particles enclosed between the display substrate and the back surface substrate so as to move according to an electric field generated between the display substrate and the back surface substrate by applying a voltage corresponding to an image between the first electrode and the second electrode; the driving device including: a voltage application section that applies the voltage corresponding to an image between the first electrode and the second electrode, the voltage application section, as a display drive voltage to be applied for each pixel to display a desired color at each pixel, applying a first pulse voltage that can cause the particles in a stationary state to start moving and thereafter applying a second pulse voltage that can cause the particles that have started moving to move.

According to the aspect, the particles in the stationary state can be started moving to be driven sufficiently, therefore dot defect and the like is effectively prevented. Further, after the particles start moving, because of applying the voltage that is merely necessary to be able to cause the particles that have started moving to move, the particles can be driven effectively.

BRIEF DESCRIPTION OF THE DRAWINGS

Exemplary embodiments of the invention will be described in detail with reference to the following figures, wherein.

DETAILED DESCRIPTION

The exemplary embodiments of the present invention will now be described in detail with reference to the drawings.

Figure 1:
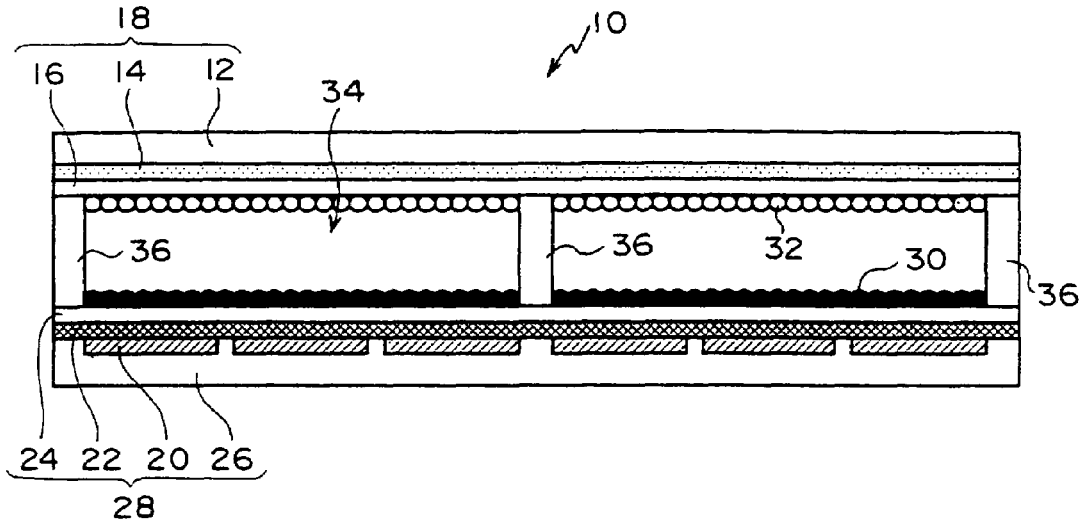
FIG. 1 is a cross sectional view of an image display medium.

FIG. 1 shows a cross sectional view of an image display medium 10 according to the present exemplary embodiment. As shown in the figure, the image display medium 10 is configured to include: a display substrate 18 having plural line-shaped transparent scanning electrodes 14 and a transparent insulating layer 16 formed on a transparent substrate 12; a back surface substrate having line-shaped data electrodes 20 arranged facing the scanning electrodes 14 so as to be orthogonal thereto, a colored layer 22, and a transparent insulating layer 24 formed on a substrate 26; black particles 30 having positive chargeability and white particles 32 having negative chargeability enclosed between the substrates; and a gap member 36 for partitioning the space between the substrates into plural cells 34, as shown in FIG. 2.

The colored layer 22 is a layer colored to a color different from the black particles 30 and the white particles 32, and is assumed as being colored red in the present exemplary embodiment.

Figure 2:
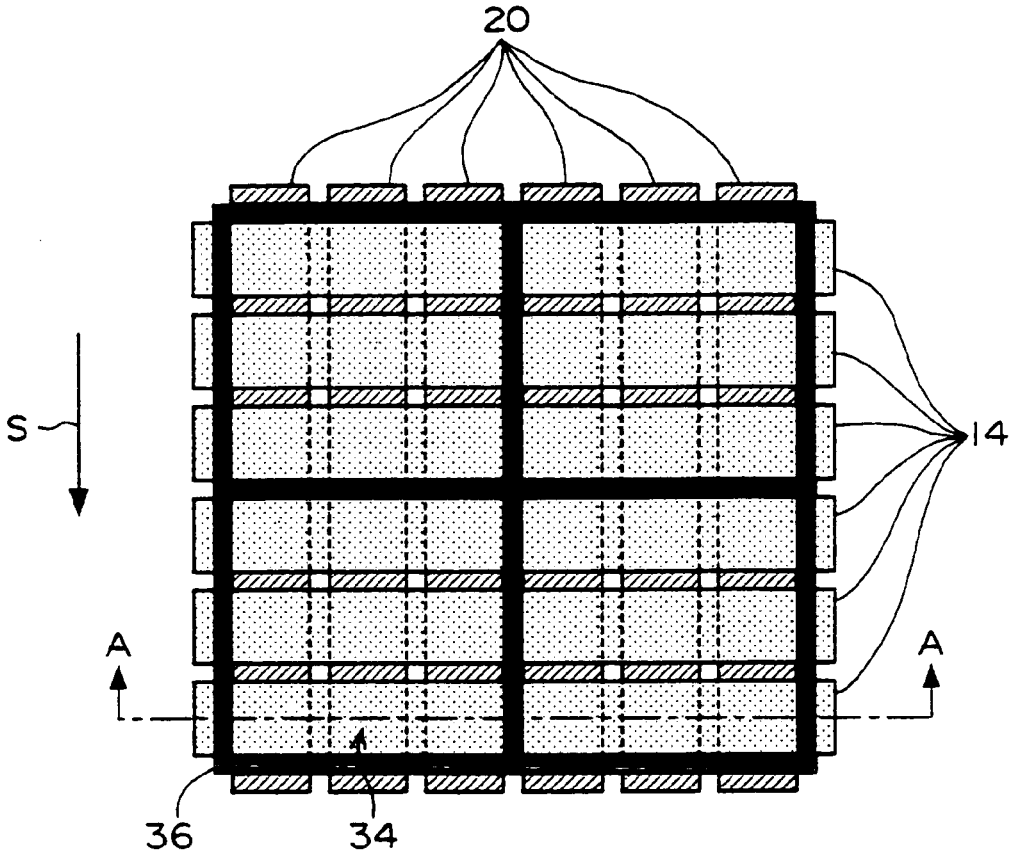
FIG. 2 is a plan view showing the arrangement of electrodes and the shape of a gap member.

The image display medium 10 shown in FIG. 1 is a cross sectional view taken along line A-A of FIG. 2. In FIG. 2, the gap member 36 is shown in black for clear illustration, but is not limited thereto, and may actually be configured by a transparent member and the like.

As shown in FIG. 2, the plural line-shaped scanning electrodes 14 are arranged in parallel in the up and down direction (scanning direction S) in FIG. 2, and arranged facing the plural line-shaped data electrodes 20 arranged in parallel in the left and right direction in FIG. 2 so as to be orthogonal thereto. The interesting position between each scanning electrode 14 and each data electrode 20 configure the pixel. Each electrode is configured by an ITO (Indium Tin Oxide) electrode and the like.

The gap member includes plural scanning electrodes 14 and plural data electrodes 20, and is formed into a grid configuration so as to form plural cells 34. In FIG. 2, a configuration in which three scanning electrodes 14 and three data electrodes 20 are arranged in each cell 34, that is, a configuration of 3×3 pixels per one cell is shown by way of example, but is not limited thereto.

In FIGS. 1 and 2, an electrode arrangement of a simple matrix configuration of 6×6 is shown to simplify the description, but actually, the electrode of the number corresponding to the number of pixels necessary for image display are formed in each substrate. That is, if pixels worth of m×n are required, m scanning electrodes 14 are formed on the substrate 12, and n data electrodes 20 are formed on the substrate 26.

In the present exemplary embodiment, a configuration of arranging the scanning electrodes 14 on the display substrate side and the data electrodes 20 on the back surface substrate side is provided, but the data electrodes 20 may be arranged on the display substrate side and the scanning electrodes 14 on the back surface substrate side.

The scanning electrodes 14 and the data electrodes 20 may be formed not on the surfaces of the sides at which the display substrate 18 and the back surface substrate 28 face each other, but on the surfaces on the opposite sides, or may be separately and independently arranged on the outer sides of the display substrate 18 and the back surface substrate 28. When arranging the electrodes separately and independently from the image display medium, an electric field is created between the substrates by configuring the substrate with a member having dielectric property.

In the present exemplary embodiment, the black particles 30 have positive chargeability and the white particles 32 have negative chargeability, but the black particles 30 may have negative chargeability and the white particles 32 may have positive chargeability. Each particle may be an insulating particle, an electrically conductive particle or the like.

Each member configuring the image display medium 10 may be those disclosed in, for example, Japanese Patent Application Laid-Open (JP-A) No. 2001-312225.

In such image display medium 10, when a predetermined voltage (e.g., ±140 V), which is a voltage necessary to generate a potential difference between the substrates for at least being able to move the particles and which is a voltage that ensures the required density, is applied between the electrodes of the scanning electrode 14 and the data electrode 20, the black particles 30 and the white particles 32 at the relevant position move between the substrates. For example, when a predetermined voltage (e.g., +140 V), at which the potential of the scanning electrode 14 becomes positive with respect to the data electrode 20, is applied between the electrodes, the black particles 30 having positive chargeability on the display substrate 18 side move to the back surface substrate 28 side, and the white particles 32 having negative chargeability on the back surface substrate 28 side move to the display substrate 18 side, thereby "white" being displayed.

When a predetermined voltage (e.g. −140 V), at which the potential of the scanning electrode 14 becomes negative with respect to the data electrode 20, is applied between the electrodes, the white particles 32 having negative chargeability on the display substrate 18 side move to the back surface substrate 28 side and the black particles 30 having positive chargeability on the back surface substrate 28 side move to the display substrate 18 side, thereby "black" being displayed.

Therefore, when a predetermined positive or negative voltage is applied between the data electrode 20 and the scanning electrode 14 of the position corresponding to the pixel to which the particles are be moved, the particles move according to the image, and the image is displayed. The black particles 30 or the white particles 32 remain adhered to the display substrate 18 or the back surface substrate 28 by van der Waals' force or image force even after the application of the voltage is stopped, thereby maintaining the image-display.

Figure 3A:
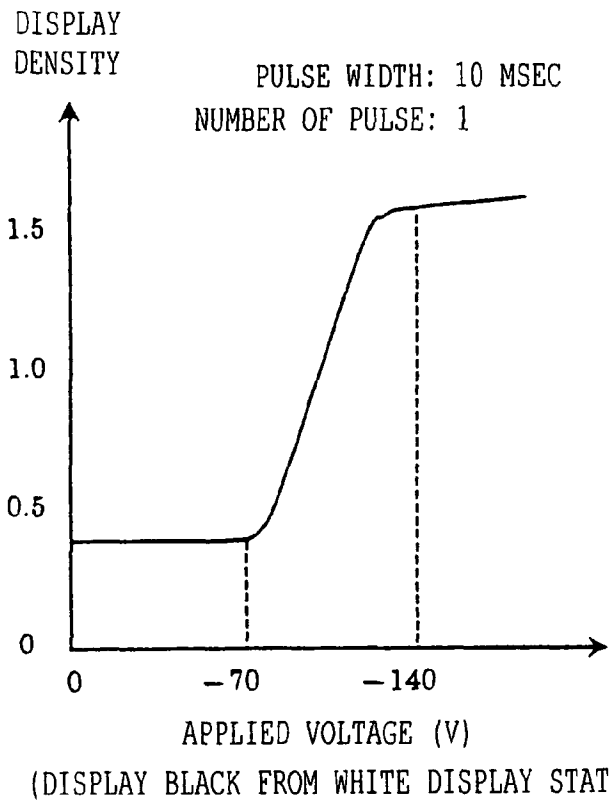
FIG. 3A is a diagram showing the density property of when obtaining black display from white display.
Figure 3B:
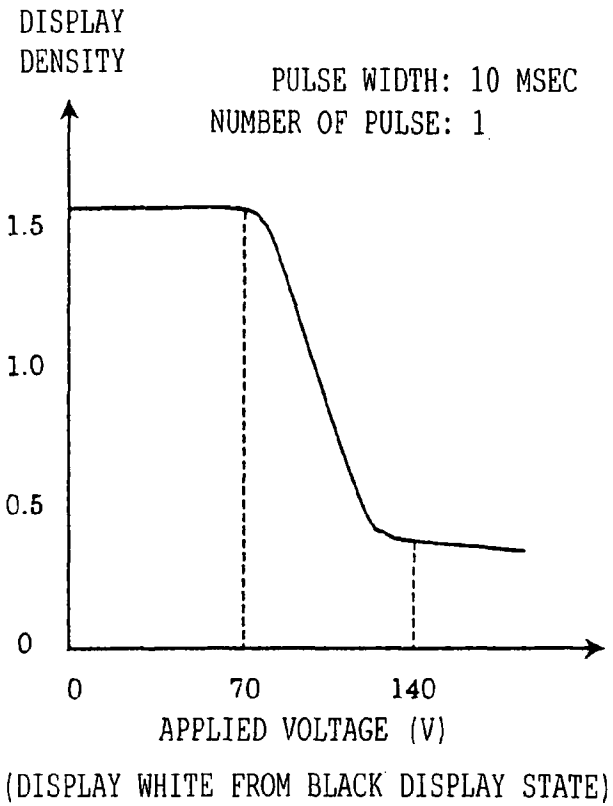
FIG. 3B is a diagram showing the density property of when obtaining white display from black display.

In the present exemplary embodiment, a case in which the density property of the image display medium 10 is the property shown in FIG. 3A and FIG. 3B will now be described by way of example. That is, the property is such that the black particles 30 or the white particles 32 move to the display substrate 18 side to obtain a sufficient density when the voltage applied to the scanning electrode 14 is −140 V or 140 V with respect to the data electrode 20, and such that the movement of the particles is prohibited when the voltage applied to the scanning electrode 14 is −70 V or 70 V with respect to the data electrode 20. In the figures, an example in which the pulse width of the application voltage is 10 msec and the number of pulse is 1 is shown.

Figure 4A:
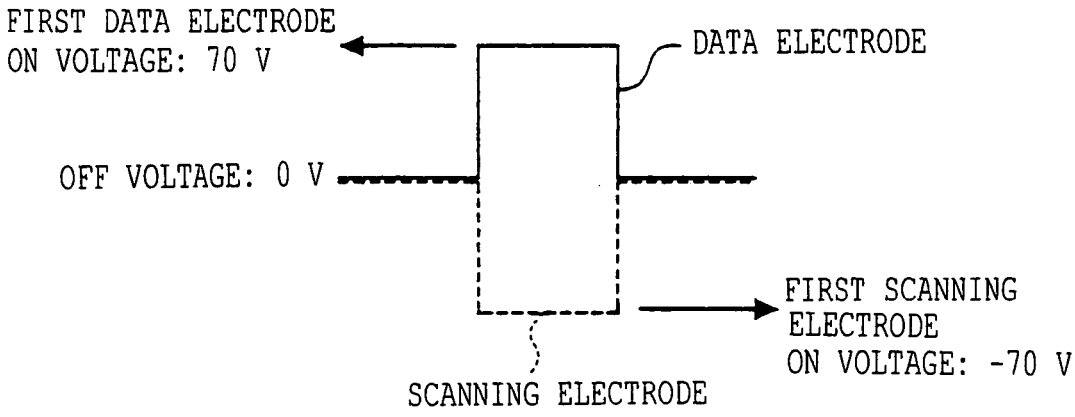
FIG. 4A is a view explaining the ON voltage and the OFF voltage to be applied to each electrode.

The ON voltage and the OFF voltage for black display to be applied to the scanning electrode 14 and the data electrode 20, that is, the value of the voltage to be applied to each electrode when moving the black particles 30 to the display substrate 18 side may be set to various values, where the first scanning electrode ON voltage to be applied to the scanning electrode 14 is set to −70 V, the first data electrode ON voltage to be applied to the data electrode 20 is set to +70 V, and the OFF voltage to be applied to the scanning electrode 14 and the data electrode 20 is set to 0 V in the present exemplary embodiment, as shown in FIG. 4A.

Similarly, the ON voltage and the OFF voltage for white display to be applied to the scanning electrode 14 and the data electrode 20, that is, the value of the voltage to be applied to each electrode when moving the white particles 32 to the display substrate 18 side may be set to various values, where the second scanning electrode ON voltage to be applied to the scanning electrode 14 is set to +70 V with opposite polarity from the first scanning electrode ON voltage, the second data electrode ON voltage to be applied to the data electrode 20 is set to −70 V with opposite polarity from the first data electrode ON voltage, and the OFF voltage is set to 0 V, similar to the OFF voltage for black display, in the present exemplary embodiment.

Figure 4B:
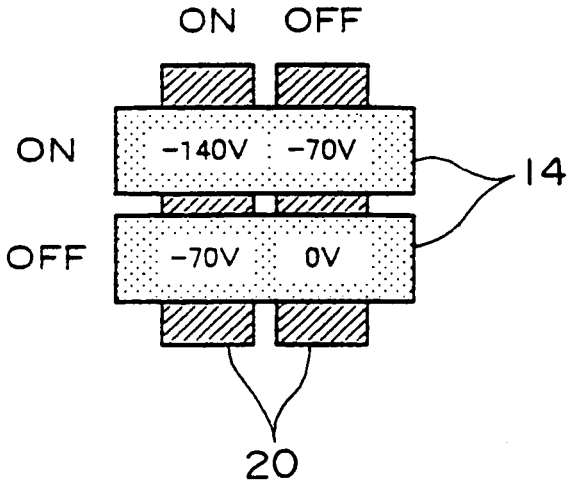
FIG. 4B is a view explaining the voltage to be applied to each position when the ON voltage or the OFF voltage is applied to each electrode.

When the ON voltage and the OFF voltage for black display are set as mentioned above, if the ON voltage for black display is applied to both the scanning electrode 14 and data electrode 20, as shown in FIG. 4B, the application voltage to the scanning electrode 14 with respect to the data electrode 20 becomes −140 V, and the black particles 30 of the relevant pixel (image part) move to the display substrate 18 side.

In the present exemplary embodiment, the number of pulses for black display voltage to be applied between the substrates is in plurals to enhance the black and white display contrast, Further, the present exemplary embodiment, in order to shorten the display switching time, the pulse width of the pulse voltage to be applied at a first time is set to a pulse width longer than the normal pulse width, that is, set to a pulse width (first pulse width) that can sufficiently cause the particles in a stationary state to start moving, and the pulse width of the pulse voltage to be subsequently applied is set to a pulse width (second pulse width) that can sufficiently drive the particles that have started moving, which pulse width is shorter than the pulse width of the pulse voltage that is applied at the first time. The details will be hereinafter described, when displaying the red color of the back surface substrate, the pulse voltage of the first pulse width is applied at a first time, and thereafter, the pulse voltage of the second pulse width is applied, similar to the black display.

Figures 5A, 5B, 5C:
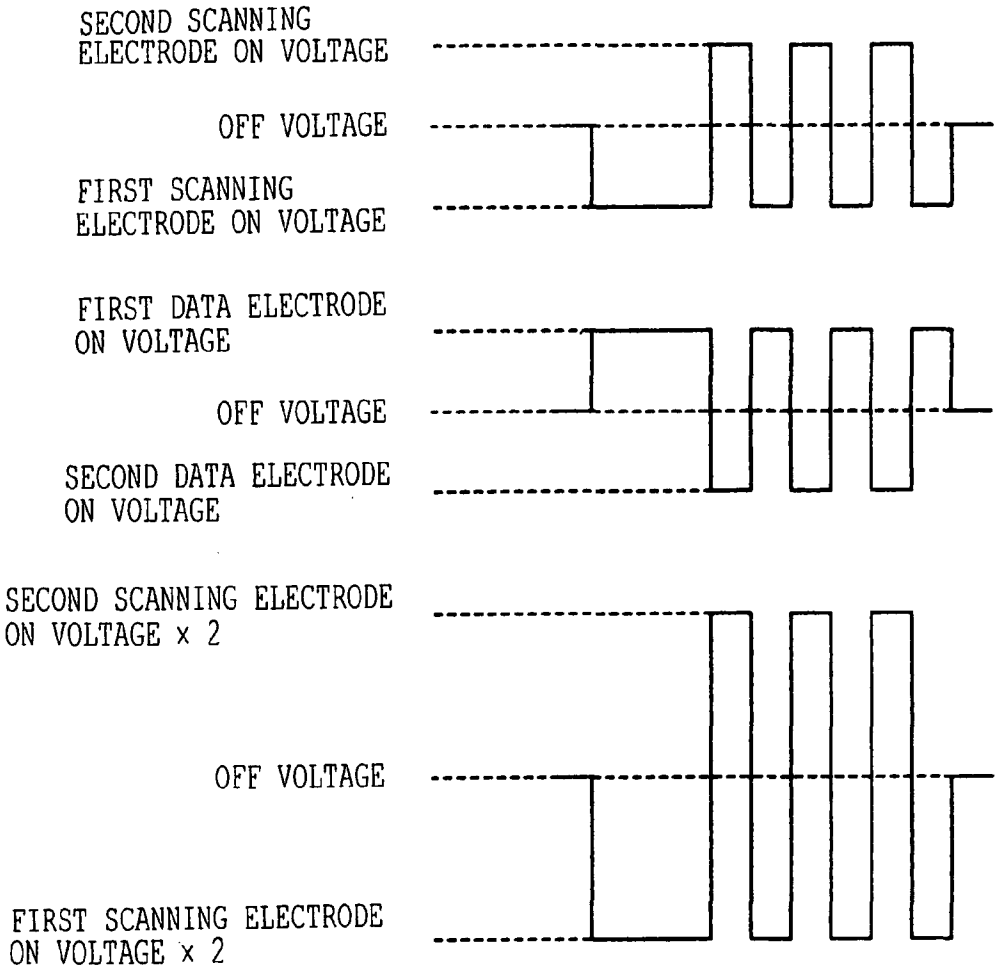
FIGS. 5A-5C are waveform charts of the voltage applied in black display.

Specifically, the first scanning electrode ON voltage of the first pulse width is applied first, and thereafter, the second scanning electrode ON voltage of the second pulse width and the first scanning electrode ON voltage of the second pulse width are alternately applied for a few pulses to the scanning electrode 14 to be scanned, as shown in FIG. 5A. The voltage to be applied last is the first scanning electrode ON voltage of the second pulse width so that the black particles 30 eventually move to the display substrate 18 side.

To the data electrode 20 corresponding to the pixel to be displayed black, the first data electrode ON voltage of the first pulse width is first applied, and thereafter, the second data electrode ON voltage of the second pulse width and the first data electrode ON voltage of the second pulse width are alternately applied for a few pulses, as shown in FIG. 5B. The voltage to be applied last is the first data electrode ON voltage of the second pulse width so that the black particles 30 eventually move to the display substrate 18 side.

In other words, the pulse voltages which phase differs by 180 degrees are applied to the scanning electrode 14 and the data electrode 20. As shown in FIG. 5C, the voltage (−140 V) which is twice the first scanning electrode ON voltage is first applied at the first pulse width, and thereafter, the voltage (−140V) which is twice the first scanning electrode ON voltage and the voltage (+140 V) which is twice the second scanning electrode ON voltage are alternately applied at the second pulse width for a few pulses, to the scanning electrode 14, with respect to the data electrode 20, as the display drive voltage.

Therefore, the pulse width of the voltage applied first is the pulse width that can sufficiently cause the particles in a stationary state to start moving, and the pulse width of the subsequently applied voltage is shorter than the pulse width of the voltage applied first, whereby the particles are sufficiently driven in a short period of time, the black and white display contrast becomes satisfactory, and the display switching time becomes shorter compared to the prior art.

In FIGS. 5A, 5B and 5C, the waveform of the voltages to be applied is shown as a rectangle, but is not limited thereto, and each pulse does not necessarily need to be continuous.

When the first scanning electrode ON voltage is applied to the scanning electrode 14 and the OFF voltage is applied to the data electrode 20, the application voltage to the scanning electrode 14 with respect to the data electrode 20 becomes −70 V, and the particles of the relevant pixel (non-image part) do not move. Similarly, when the OFF voltage is applied to the scanning electrode 14 and the first data electrode ON voltage is applied to the data electrode 20, the application voltage to the scanning electrode 14 with respect to the data electrode 20 becomes −70 V, and the particles of the relevant pixel do not move, and when the OFF voltage is applied to the scanning electrode 14 and the OFF voltage is applied to the data electrode 20, the application voltage to the scanning electrode 14 with respect to the data electrode 20 becomes 0 V, and the particles of the relevant pixel do not move. The case for the white display is similar to the case for the black display except for the polarity being inverted.

When performing an initialization drive for equalizing the arrangement of the particles within the cell 34, that is, the particle density, and eventually obtaining the white display, an alternating voltage serving as the initialization drive voltage is applied between the scanning electrode 14 and the data electrode 20. For example, assuming the first scanning electrode initialization voltage is 140 V and the second scanning electrode initialization voltage is 0 V, such initialization voltages are alternately applied to the scanning electrode 14 at a predetermined pulse width, and in synchronization therewith, assuming the first data electrode initialization voltage is 0 V and the second data electrode initialization voltage is 140 V, such initialization voltages are alternately applied to the data electrode 20 at the predetermined pulse width. The alternating voltage is thereby applied between the scanning electrode 14 and the data electrode 20.

The above applications are executed for a predetermined number of pulses, and the first scanning electrode initialization voltage is applied to the scanning electrode 14 and the first data electrode initialization voltage is applied to the data electrode 20 to eventually obtain a white display. Preferably, application is executed at the pulse width longer than the predetermined pulse width to perform the white display of a more stable density. The predetermined number of pulse is set to a number that can sufficiently equalize the arrangement of the particles.

Figures 6A, 6B, 6C:
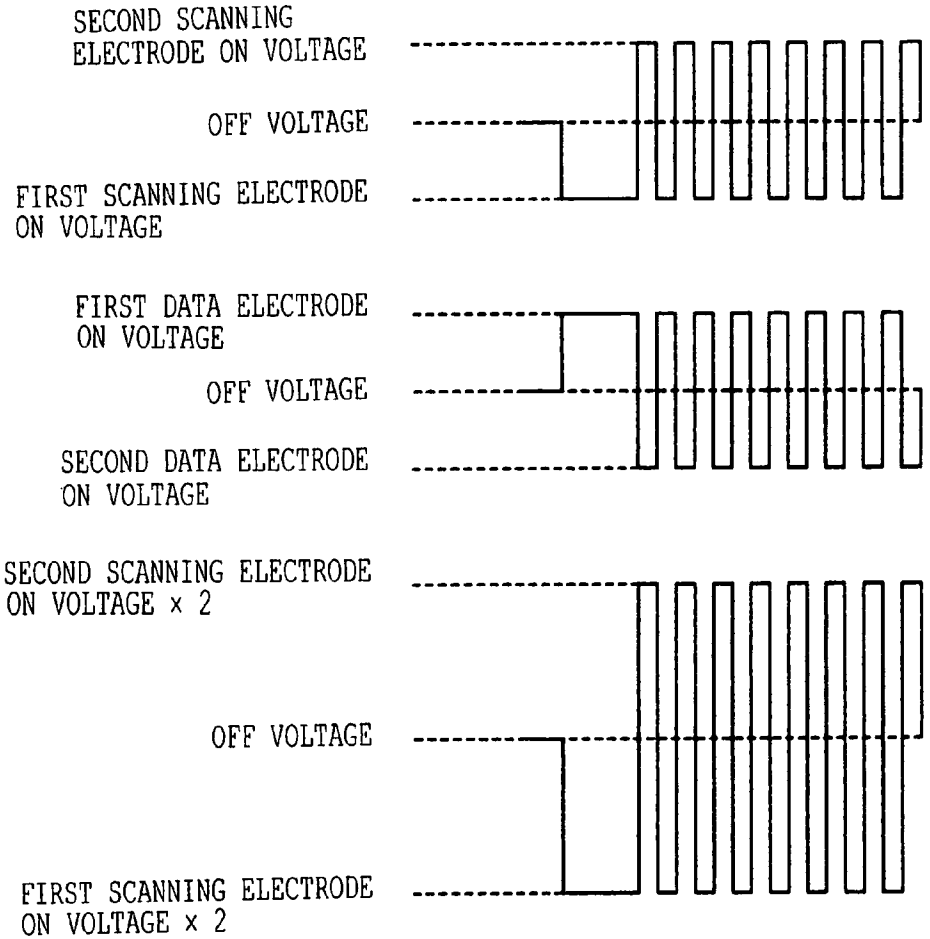
FIGS. 6A-6C are waveform charts of the voltage applied in red display.

When displaying the color other than the particles, that is, the color of the colored layer 22 at a predetermined pixel in the cell, the first scanning electrode ON voltage of long pulse width that can sufficiently cause the particles in a stationary state to start moving is applied first, and thereafter, the second scanning electrode ON voltage of short pulse width that can sufficiently drive the particles that have started moving and the first scanning electrode ON voltage of the short pulse width are alternately applied for a few tens of the pulses to the scanning electrode 14 to be scanned, similar to the black display, as shown in FIG. 6A. The number of pulses is more than that in the black display. The voltage value of the voltage to be applied may be higher than that in the black display.

The first data electrode ON voltage of long pulse width is first applied, and thereafter, the second data electrode ON voltage of short pulse width and the first data electrode ON voltage of short pulse width are alternately applied for a few pulses to the data electrode 20 corresponding to the pixel to be displayed red, similar to the black display, as shown in FIG. 6B.

Therefore, with respect to the data electrode 20, the voltage (−140 V) which is twice the first scanning electrode ON voltage is first applied at a long pulse width and thereafter, the voltage (−140 V) which is twice the first scanning electrode ON voltage and the voltage (+140 V) which is twice the second scanning electrode ON voltage are alternately applied at a short pulse width for a few pulses to the scanning electrode 14, as the display drive voltage, as shown in FIG. 6C.

The OFF voltage is applied to the scanning electrodes 14 and the data electrodes 20 corresponding to the pixels other than the predetermined pixel.

Thus, particles in the region of the predetermined pixel move to the region in another pixel in the cell by the edge electric field (electric field in a direction parallel to the substrate surface) generated between the adjacent data electrode while reciprocating between the substrates, so that the colored layer 22 is exposed and the red color is displayed at the predetermined pixel.

The pulse width of the voltage applied first is the pulse width that can sufficiently cause the particles in a stationary state to start moving, and the pulse width of the subsequently applied voltage is shorter than the pulse width of the voltage applied first, so that the particles are sufficiently driven compared to the conventional art, and the dot defect in the red display is prevented.

Figure 7:
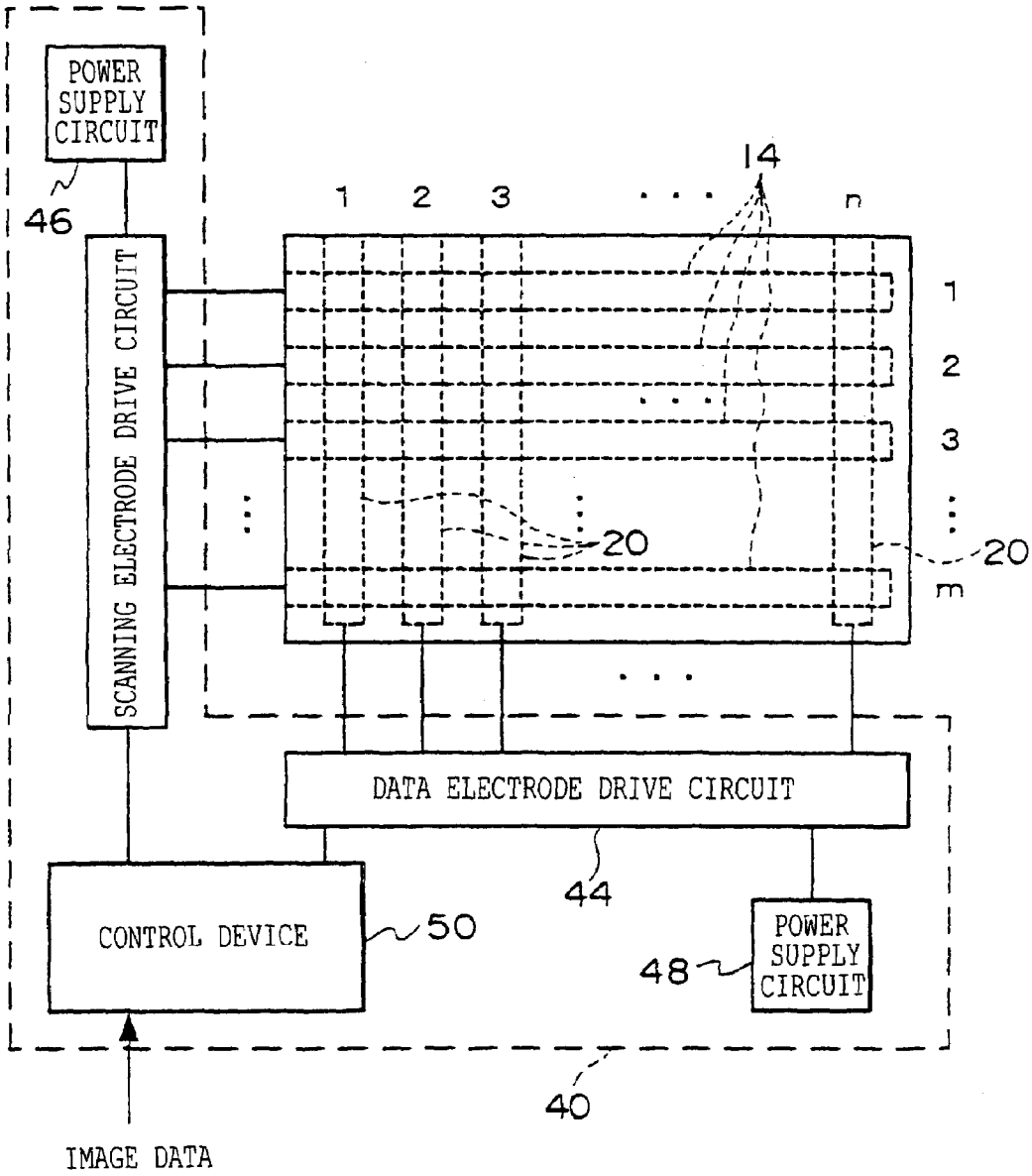
FIG. 7 is a schematic configuration view of an image display device.

FIG. 7 shows a schematic configuration of a driving device 40 for displaying an image on the image display medium 10 based on the image data.

The driving device 40 is configured including a scanning electrode drive circuit 42, a data electrode drive circuit 44, power supply circuits 46 and 48, and a control device 50.

The scanning electrode drive circuit 42 is connected to each scanning electrode 14, and applies various voltages supplied from the power supply circuit 46, that is, the first scanning electrode initialization voltage and the second scanning electrode initialization voltage, the first scanning electrode ON voltage and the second scanning electrode ON voltage, the OFF voltage and the like to each scanning electrode 14 according to the instruction of the control device 50.

The data electrode drive circuit 44 is connected to each data electrode 20, and applies various voltages supplied from the power supply circuit 48, that is, the first data electrode initialization voltage and the second data electrode initialization voltage, the first data electrode ON voltage and the second data electrode ON voltage, the OFF voltage and the like to each data electrode 20 according to the instruction of the control device 50.

The scanning electrode drive circuit 42 is connected to each scanning electrode 14, and applies various voltages supplied from the power supply circuit 46 to each scanning electrode 14 according to the instruction from the control device 50.

The data electrode driving circuit 44 is connected to each data electrode 20, and applies various voltages supplied from the power supply circuit 48 to each data electrode 20 according to the instruction from the control device 50.

The image data corresponding to the image to be displayed on the image display medium 10 is input to the control device 50. The control device 50 outputs, based on the input image data, a row number specifying signal for specifying the row number of the scanning electrode 14 to be scanned and a scanning electrode voltage specifying signal for specifying the type of application voltage, to the scanning electrode driving circuit 42, and also outputs a column number specifying signal for specifying the column number of the data electrode 20 to be applied with a predetermined voltage and a data electrode voltage specifying signal for specifying the type of predetermined voltage, based on the line image corresponding to the scanning electrode 14 specified by the row number specifying signal, to the data electrode driving circuit 44.

The scanning electrode drive circuit 42 applies the voltage of the type specified by the scanning electrode voltage specifying signal to the scanning electrode 14 of the row specified by the row number specifying signal from the control device 50, and applies the OFF voltage to the scanning electrodes 14 other than the scanning electrode 14 specified by the row number specifying signal.

The data electrode drive circuit 44 applies the voltage of the type specified by the data electrode voltage specifying signal to the data electrode 20 of the column specified by the column number specifying signal from the control device 50, and applies the OFF voltage to the data electrodes 20 other than the data electrode 20 specified by the column number specifying signal.

The voltage application sequence of the image display drive executed in the control device 50 will now be described.

The control device 50 first initializes the image display medium 10. In other words, the control device 50 instructs the scanning electrode drive circuit 42 and the data electrode drive circuit 44 so that the pulse voltages of a predetermined number of pulses having phases that differ by 180 degrees are applied to all the scanning electrodes 14 and the data electrodes 20, and furthermore, so that eventually the first scanning electrode initialization voltage is applied to the scanning electrodes 14 and the first data electrode initialization voltage is applied to the data electrodes 20, in order to equalize the particles and to obtain an entirely white display. The particles between the substrates are thereby equalized, and ultimately, all the white particles 32 move to the display substrate side 18 and all the black particles 30 move to the back surface substrate 28 side, thereby obtaining an entirely white display.

The control device 50 then outputs a row number specifying signal for specifying the scanning electrode 14 in the first row and a scanning electrode voltage specifying signal for specifying the scanning electrode pulse voltage as shown in FIG. 5A to the scanning electrode drive circuit 42, and also outputs a column number specifying signal for specifying the data electrode 20 corresponding to the pixel to be displayed black in the first row and a data electrode voltage specifying signal for specifying the data electrode pulse voltage as shown in FIG. 5B to the data electrode drive circuit 44.

The voltage having a long pulse width is first applied, and thereafter, the alternating voltage having a short pulse width, such as shown in FIG. 5C, is applied between the scanning electrode 14 and the data electrode 20 corresponding to the pixel to be displayed black. The OFF voltage is applied to the other electrodes.

The black and white line image is thereby displayed on the first row. The OFF voltage is applied to the other electrodes.

The black and white line images are sequentially displayed by repeating the processes similar to the above for the second and subsequent rows, thereby displaying a black and white image.

The control device 50 then outputs a row number specifying signal for specifying the scanning electrode 14 in the first row and a scanning electrode voltage specifying signal for specifying the scanning electrode pulse voltage as shown in FIG. 6A to the scanning electrode drive circuit 42, and also outputs a column number specifying signal for specifying the data electrode 20 corresponding to the pixel to be displayed red on the first row and a data electrode voltage specifying signal for specifying the data electrode pulse voltage as shown in FIG. 6B to the data electrode drive circuit 44.

The alternating voltage for removing particles as shown in FIG. 6C is thereby applied to between the scanning electrode 14 and the data electrode 20 corresponding to the pixel to be displayed red. The OFF voltage is applied to the other electrodes.

The particles between the scanning electrode 14 and the data electrode 20 corresponding to the pixel to be displayed red move to the region of other pixel, that is, the region of the pixel to be displayed white or the region of the pixel to be displayed black, while reciprocating between the substrates. The colored layer 22 is thereby exposed, and the red color is displayed.

The line image is sequentially displayed by repeating the processes similar to the above for the second row as well, and the color image of red, white and black is displayed.

Figure 8A:
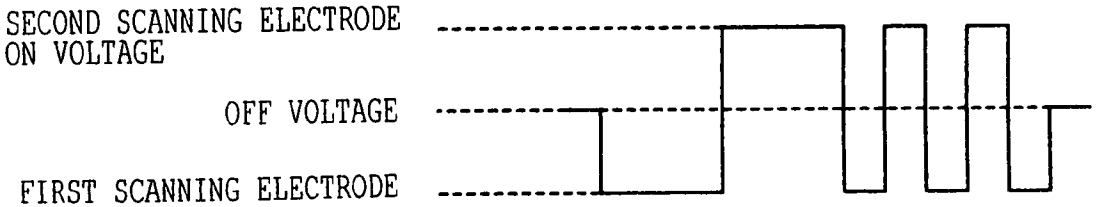
FIGS. 8A-8C are waveform charts of another example of the voltage applied in black display.
Figure 8B:
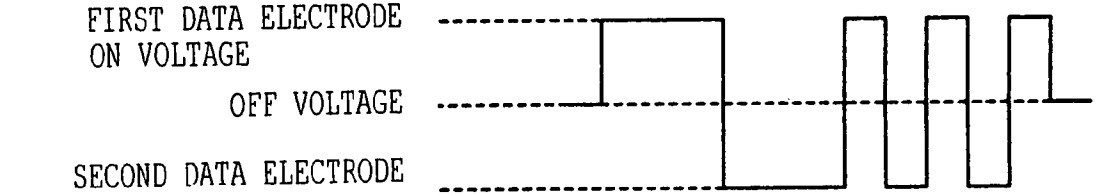
Figure 8C:
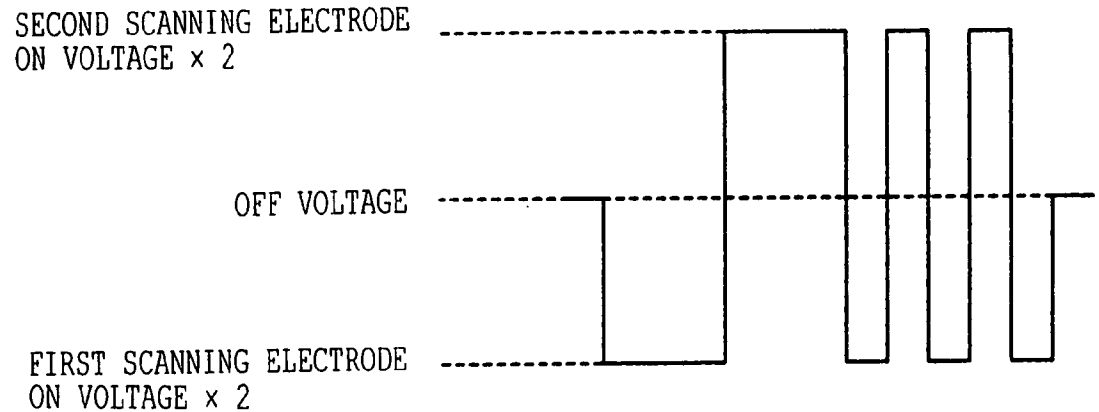

In the present exemplary embodiment, in black display, a case of first applying the voltage of long pulse width once, and thereafter, applying the voltage of shorter pulse width has been explained, but the voltage of long pulse may be applied over plural times, that is, the alternating voltage of long pulse width may be applied, and thereafter, the alternating voltage of short pulse width may be applied, as shown in FIGS. 8A, 8B, and 8C. This is the same for the red display.

Figure 9A:
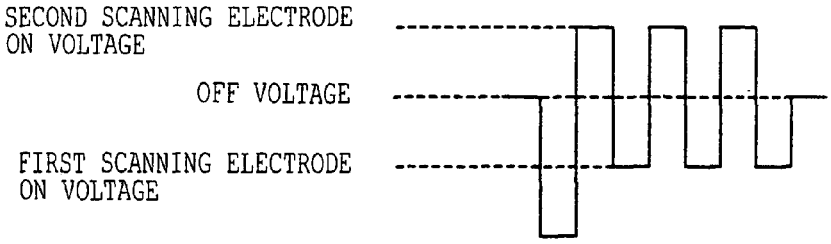
FIGS. 9A-9C are waveform charts of another example of the voltage applied in black display.
Figure 9B:
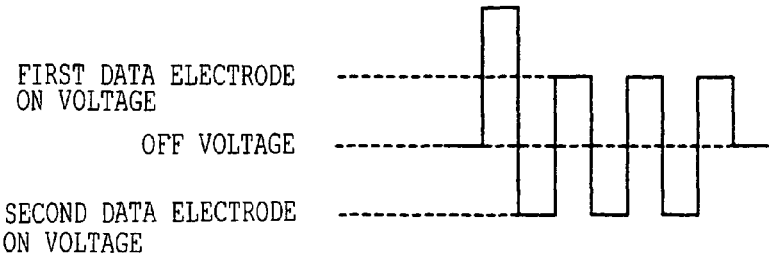
Figure 9C:
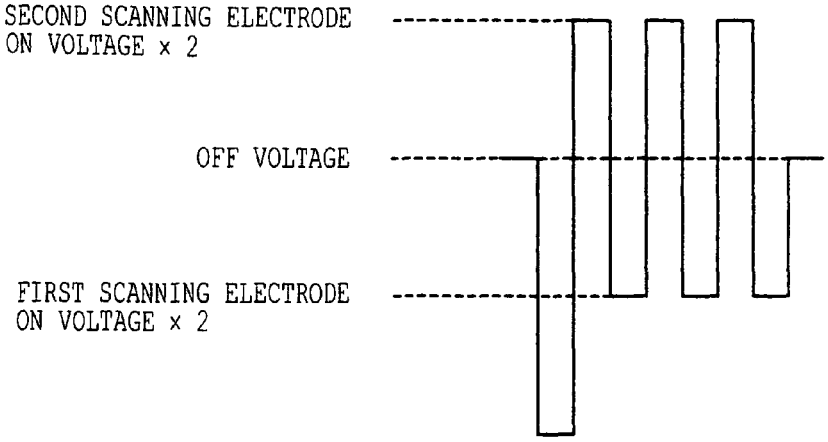
Figure 10A:
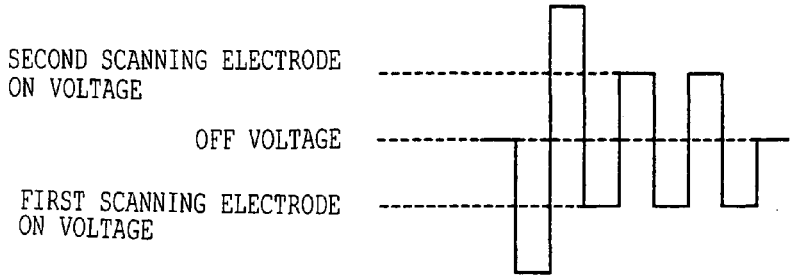
FIGS. 10A-10C are waveform charts of another example of the voltage applied in black display.
Figure 10B:
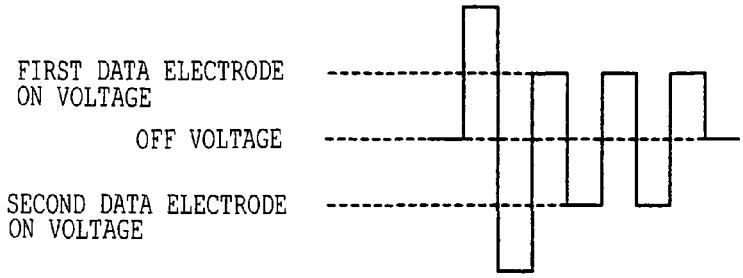
Figure 10C:
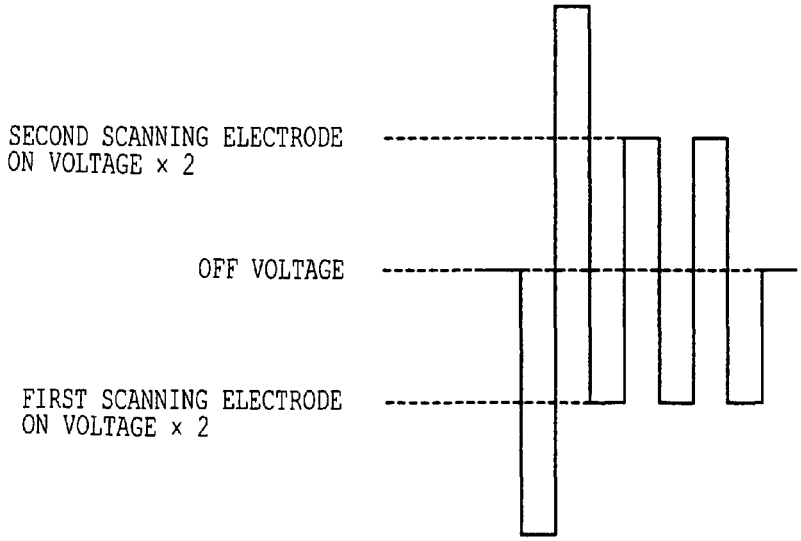

Furthermore, instead of having a long pulse width for the voltage to be applied first, the pulse width may all be the same, and the voltage of high voltage value may first be applied, that is, the voltage that can sufficiently cause the particles in the stationary state to start moving may be applied once, and then the voltage lower than the voltage applied first, that is, the voltage that can sufficiently drive the particles that have started moving may be applied, as shown in FIGS. 9A, 9B and 9C. Moreover, as shown in FIGS. 10A, 10B and 10C, the pulse width may all be the same, and the voltage of high voltage value may be applied over plural times, that is, the alternating voltage of high voltage value may be applied first, and thereafter, the alternating voltage lower than the alternating voltage applied first may be applied. This is the same for the red display.

The high voltage of long pulse width may be applied first, and thereafter, the voltage of shorter pulse width and lower than those of the voltage applied first may be applied.

The voltage of long pulse width or the high voltage is not limited to being applied first and the voltage of long pulse width or the high voltage may be applied in the middle.

The frequency of the voltage to be applied may gradually shift from low frequency to high frequency.

A sequence in which an entirely white display is obtained, then the black display is obtained with respect to each row and then the red display is obtained is described in the present exemplary embodiment, but may be a sequence of obtaining the black display after the red display.

The present invention is applied to the black display and the red display in the present exemplary embodiment, but is not limited thereto, and the invention may be applied to the initialization drive.

In the present exemplary embodiment, a case of displaying the image on the image display medium in which the arrangement of the electrodes is a simple matrix configuration has been described, but the invention is also applicable to the image display medium in which the arrangement of the electrodes is an active matrix configuration.

What is claimed is:

1. A driving device for an image display medium that drives the image display medium comprising:

a display substrate having at least translucency;

a back surface substrate facing the display substrate with a gap therebetween;

a plurality of first electrodes arranged in parallel along a predetermined direction;

a plurality of second electrodes arranged facing the first electrodes; and particles enclosed between the display substrate and the back surface substrate so as to move according to an electric field generated between the display substrate and the back surface substrate by applying a voltage corresponding to an image between the first electrode and the second electrode;

the driving device comprising:

a voltage application section that applies the voltage corresponding to an image between the first electrode and the second electrode, wherein the voltage application section, as a display drive voltage to be applied for each pixel to display a desired color at each pixel, applies a first pulse voltage configured to cause the particles in a stationary state to start moving and immediately after application of the first pulse voltage, applies a second pulse voltage that can cause the particles that have started moving to move, the first pulse voltage consists of a single pulse, and the second pulse voltage consists of a plurality of pulses that alternately have a positive value and a negative value of a same absolute amount, with each pulse also having a same width.

2. The driving device for an image display medium of claim 1, wherein the first pulse voltage is a voltage of a first pulse width that can cause the particles in the stationary state to start moving, and the second pulse voltage is a voltage of a second pulse width that can cause the particles that have started moving to move, and the second pulse width is shorter than the first pulse width.

3. The driving device for an image display medium of claim 2, wherein the voltage application section applies the first pulse voltage first when applying a plurality of pulse voltages.

4. The driving device for the image display medium of claim 2, wherein the voltage application section applies the first pulse voltage that can cause the particles in a state in which the particles are adhered to the display substrate or the back surface substrate to separate therefrom, and thereafter applies the second pulse voltage that can cause the particles in a state in which the particles are apart from the display substrate or the back surface substrate to move.

5. The driving device for an image display medium of claim 1, wherein the first pulse voltage is a voltage of a first voltage value that can cause the particles in the stationary state to start moving, and the second pulse voltage is a voltage of a second voltage value that can cause the particles that have started moving to move, and the second voltage value is lower than the first voltage value.

6. The driving device for an image display medium of claim 5, wherein the voltage application section applies the first pulse voltage first when applying a plurality of pulse voltages.

7. The driving device for the image display medium of claim 5, wherein the voltage application section applies the first pulse voltage that can cause the particles in a state in which the particles are adhered to the display substrate or the back surface substrate to separate therefrom, and thereafter applies the second pulse voltage that can cause the particles in a state in which the particles are apart from the display substrate or the back surface substrate to move.

8. The driving device for an image display medium of claim 1, wherein the voltage application section applies the first pulse voltage first when applying a plurality of pulse voltages.

9. The driving device for an image display medium of claim 1, wherein the particles have a color different from the back surface substrate.

10. The driving device for an image display medium of claim 1, wherein the particles comprise a plurality of types of particles each having different color and/or different charging property.

11. The driving device for an image display medium of claim 1, wherein the plurality of first electrodes are electrodes of a scanning electrode group in which a plurality of line-shaped scanning electrodes are arranged in parallel, and the plurality of second electrodes are electrodes of a data electrode group in which a plurality of line-shaped data electrodes intersecting the scanning electrodes are arranged in parallel.

12. The driving device for the image display medium of claim 1, wherein the voltage application section applies the first pulse voltage that can cause the particles in a state in which the particles are adhered to the display substrate or the back surface substrate to separate therefrom, and thereafter applies the second pulse voltage that can cause the particles in a state in which the particles are apart from the display substrate or the back surface substrate to move.

13. The driving device for the image display medium of claim 1, wherein application of the second pulse voltage is immediately after application of the first pulse voltage.

14. The driving device for the image display medium of claim 1, wherein a width of a pulse of the first pulse voltage is longer that the width of each pulse of the second pulse voltage.

15. The driving device for the image display medium of claim 1, wherein a height of a pulse of the first pulse voltage is higher that the height of each pulse of the second pulse voltage.

16. The driving device for an image display medium of claim 1, wherein the first pulse voltage is a voltage which is initially applied as the display drive voltage applied for each pixel to display the desired color at each pixel.

17. A driving device for an image display medium that drives the image display medium comprising:

a display substrate having at least translucency;

a back surface substrate facing the display substrate with a gap therebetween;

a plurality of first electrodes arranged in parallel along a predetermined direction;

a plurality of second electrodes arranged facing the first electrodes; and particles enclosed between the display substrate and the back surface substrate so as to move according to an electric field generated between the display substrate and the back surface substrate by applying a voltage corresponding to an image between the first electrode and the second electrode;

the driving device comprising:

a voltage application section that applies the voltage corresponding to an image between the first electrode and the second electrode, wherein the voltage application section, as a display drive voltage to be applied for each pixel to display a desired color at each pixel, applies a first pulse voltage configured to cause the particles in a stationary state to start moving and immediately after application of the first pulse voltage, applies a second pulse voltage that can cause the particles that have started moving to move, the second pulse voltage consists of a plurality of pulses that alternately have a positive value and a negative value of a same absolute amount, with each pulse also having a same width, and a width of the first pulse voltage is lower than that of all of the plurality of pulses of the second pulse voltage.

18. The driving device for an image display medium of claim 17, wherein the first pulse voltage is a voltage which is initially applied as the display drive voltage applied for each pixel to display the desired color at each pixel.

19. A driving device for an image display medium that drives the image display medium comprising:

a display substrate having at least translucency;

a back surface substrate facing the display substrate with a gap therebetween;

a plurality of first electrodes arranged in parallel along a predetermined direction;

a plurality of second electrodes arranged facing the first electrodes; and particles enclosed between the display substrate and the back surface substrate so as to move according to an electric field generated between the display substrate and the back surface substrate by applying a voltage corresponding to an image between the first electrode and the second electrode;

the driving device comprising:

a voltage application section that applies the voltage corresponding to an image between the first electrode and the second electrode, wherein the voltage application section, as a display drive voltage to be applied for each pixel to display a desired color at each pixel, applies a first pulse voltage configured to cause the particles in a stationary state to start moving and immediately after application of the first pulse voltage, applies a second pulse voltage that can cause the particles that have started moving to move, the second pulse voltage consists of a plurality of pulses that alternately have a positive value and a negative value of a same absolute amount, with each pulse also having a same width, and a height of the first pulse voltage is higher than that of all of the plurality of pulses of the second pulse voltage.

20. The driving device for an image display medium of claim 19, wherein the first pulse voltage is a voltage which is initially applied as the display drive voltage applied for each pixel to display the desired color at each pixel.

* * * * *